United States Patent [19]

Hightower

[11] 4,040,184

[45] Aug. 9, 1977

[54] CUTTING INSTRUMENT

[76] Inventor: Tafari Hightower, 765 Rand Ave., Oakland, Calif. 94610

[21] Appl. No.: 627,961

[22] Filed: Nov. 3, 1975

[51] Int. Cl.[2] ..... B26B 27/00

[52] U.S. Cl. ..... 30/298; 30/336

[58] Field of Search ..... 30/298, 232, 335, 336, 30/340

[56] References Cited

U.S. PATENT DOCUMENTS

| | | | |
|---|---|---|---|
| 1,038,896 | 9/1912 | Jolly | 30/336 X |
| 1,234,846 | 7/1917 | Wilson | 30/288 |
| 1,510,198 | 9/1924 | Scott | 30/336 X |
| 1,787,375 | 12/1930 | Higbie | 30/298 |
| 1,948,623 | 2/1934 | Louderback | 30/336 X |
| 2,142,137 | 1/1939 | Leary | 30/340 |

*Primary Examiner*—James L. Jones, Jr.

*Assistant Examiner*—J. T. Zatarga

[57] ABSTRACT

The invention is a handle to which a razor blade fastens to form an improved cutting device. The handle includes a pair of rectangular sidewalls being substantially the same size as the size of the razor blade and which have a top edge, a bottom edge, a front edge and a back edge and which are joined together along their respective front, top, and bottom edges to form a casing in which the razor blade is inserted. A corner portion of each sidewall is removed in order to expose a portion of the cutting surface of a razor blade inserted therein. Also attached to the back edge of each sidewall is a tab by which a person can hold the casing between his thumb and his second finger. Attached to the top edges of the two sidewalls is an elliptical plate which is adapted to accommodate the first finger of the person guiding the cutting device thereby.

5 Claims, 5 Drawing Figures

Fig. 1.
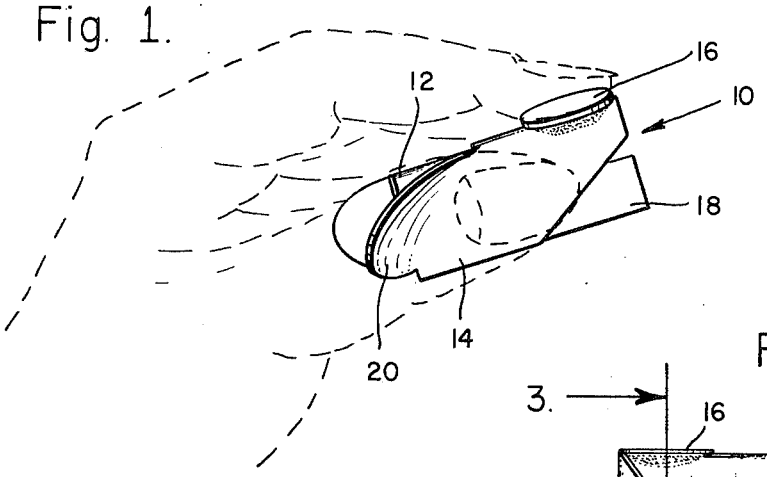
Fig. 2.
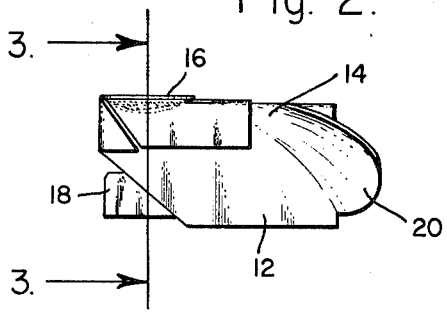
Fig. 3.
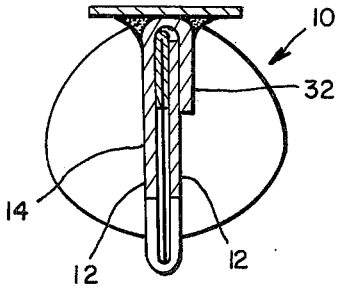
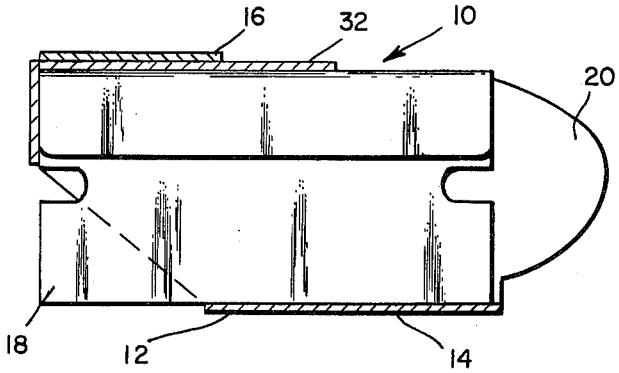
Fig. 4.
Fig. 5.
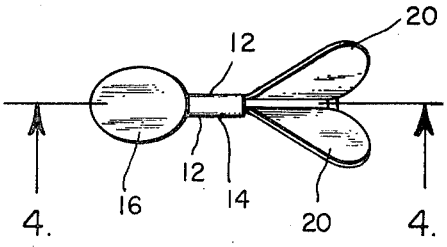

CUTTING INSTRUMENT

BACKGROUND OF THE INVENTION

1. The Field of the Invention

The present invention relates to cutting devices and more particularly to a hand held cutting device which allows the home craftsman to have precise control of the cutting edge while trimming various materials.

2. Description of the Prior Art

Presently many home craftsmen use a razor blade to cut various materials such as leather, cardboard, paper and cloth. In order to gain precise control of the cutting edge of the razor blade it is necessary to firmly grasp the blade between their thumbs and first fingers. These same craftsmen have often cut their fingers because they were unable to carefully control the cutting edge of the razor blade which has a tendency to slip out of their grasps. Their use of the razor blade does have one advantage in that it is readily available to the home craftsmen in any store.

U.S. Pat. No. 1,234,846, entitled Cutter,issued to Edgar P. Wilson on July 31, 1917, teaches a cutter which includes a holder adapted for reception of a cutting blade. The holder is formed out of a single piece of metal which is bent intermediate to its ends to form parallel legs and to have a finger piece projecting from one of the sides at the opposite end. The parallel legs have their corners cut away at one end in order to expose a cutting blade placed therein. The cutting blade is detachable mounted in the holder and has its cutting edge exposed at the corners of the parallel legs which have been cut away. The cutter further includes a detachable guard for covering the cutting edge of the cutting blade.

Many home craftsmen have been using an exacto knife instead of the razor blade. The exacto knife is a cutting device formed from metal and must be manufactured to tight engineering specifications and tolerance. Furthermore, the exacto knife has several moving parts which add to the cost of manufacturing the exacto knife. Another problem of the exacto knife is that its blade must be procured at a hardware store, hobby shop or department store, many of which are closed on Sundays. Since many home craftsmen do much of their work on Sunday this creates an added burden on the home craftsmen who might wish to purchase such a blade on a Sunday.

The home craftsman appreciates the ability that he has when using a razor blade held tightly between his thumb and his first finger to precisely control his cutting of material. He is not able to achieve this same control with an exacto knife because the manner in which he holds the exacto knife limits his ability to precisely control the movement of the blade.

SUMMARY OF THE INVENTION

In view of the foregoing factors and conditions of the prior art it is a primary object of the present invention to provide a holder for holding a razor blade in a cutting device which is formed from a plastic material and has no moving parts.

it is another object of the present invention to provide a hand held cutting device that a person may precisely control by his thumb and first two fingers rather than his thumb and first finger thereby giving him more control of the cutting device.

It is also another object of the hand held cutting device to eliminate the danger of a person's cutting himself while holding a razor blade by providing protection to his hand while he is cutting with the razor blade.

It is still another object of the present invention to provide a hand held cutting device which can hold either a single edge or a double edge razor blade which allows the home craftsman more precise control while cutting various materials.

In accordance with an embodiment of the present invention a handle for holding and controlling a rectangular razor blade of a certain size in a cutting device includes a pair of sidewalls which are joined together to form a casing adapted to hold the razor blade. The sidewalls are substantially rectangular and substantially the same size as the razor blade. Each sidewall has a top edge, a bottom edge, a front edge and a back edge with the front edge, bottom edge and top edge of each sidewall being joined together. A corner portion of the sidewalls adjacent the bottom edge and the front edge is removed in order to expose a portion of the cutting surface of a razor blade inserted therein. The holder also includes a pair of tabs coupled to the back edges of the two sidewalls which are adapted so that a person can hold the casing between his thumb and his second finger and the handle also includes an elliptical plate coupled to the top edge of the sidewalls and adapted to accommodate the first finger of the person guiding the cutting device thereby.

The features of the present invention which are believed to be novel are set forth with particularity in the appended claims.

Other objects and many of the attendant advantages of this device will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a schematic drawing of the hand held cutting device according to the principle of this invention.

FIG. 2 is a side view of the hand held cutting device of FIG. 1.

FIG. 3 is a cross-sectional view of the hand held cutting device taken along line 3—3 of FIG. 2.

FIG. 4 is a cross-sectional view of the hand held cutting device taken along line 4—4 of FIG. 5.

FIG. 5 is a top plan view of the hand held cutting device of FIG. 1.

DESCRIPTION OF THE PREFERRED EMBODIMENT

The invention can best be understood by reference to FIG. 1 wherein a person is shown holding a cutting device 10 with his thumb and his first two fingers. The cutting device 10 includes a pair of sidewalls 12 joined together to form a casing 14 and an elliptical plate 16 on which the person places his first finger which he uses to guide the cutting device 10. A razor blade 18, which is rectangular and a certain size, is inserted into the casing 14 to complete the cutting device 10.

Referring now to FIG. 2 the sidewalls 12 are substantially rectangular parallel and substantially the same size as the size of the razor blade 18. Each sidewall 12 includes a top edge, a bottom edge, a front edge and a back edge. The sidewalls 12 are joined together along their respective front, top and bottom edges to form the casing 14. A pair of tabs 20 are attached to the back edges of the sidewalls 12 to form an area on which the person places his thumb and his second finger in order to hold the cutting device 10. The advantage for a person to be able to hold the cutting device 10 with his thumb and his second finger is that he can guide the cutting device 10 with his first finger and still retain a firm hold on the cutting device 10. In contrast, he has to grip an exacto knife between his thumb and his first finger, which gives him less control than he has when gripping the present invention with his thumb and first two fingers.

The sidewalls 12 of the cutting device 10 are formed from a single piece of metal formed in much the same manner as the holder of Wilson described in the prior art section of this application. Unlike the holder of Wilson, the cutting device 10 has a finger piece, the elliptical plate 16, which is attached to the cutting device 10. The placement of the elliptical plate 16 is critical to the performance of the cutting device 10 because cutting pressure is applied by the thumb and the middle finger and control is provided by the forefinger. In the holder of Wilson, the reverse is true in that cutting pressure is applied by the forefinger and control is provided by the middle finger (see Column 2, lines 110-114). The cutting device 10 is therefore able to provide substantial cutting accuracy.

Further control of the cutting device 10 is provided by the thumb and the middle finger which grip the tabs 20 to provide cutting control in planes which are not perpendicular to the material being cut. The tabs 20 are necessary in order to provide this stability because they form a lever system with elliptical plate 16 which work in conjunction with either the thumb or middle finger and the forefinger. The holder of Wilson does not provide cutting control in planes which are not perpendicular to the material being cut.

A corner portion of the casing 14 is removed in order to expose a portion of the cutting edge of the razor blade 18. By only exposing a portion of the razor blade's 18 cutting edge the inventor has reduced the chances of a person cutting himself while using the cutting device. Furthermore, the razor blade 18 may be inserted into the casing 14 with either of its ends exposed thereby doubling the razor blade's 18 cutting life.

Referring to FIG. 3, which is a cross-section front view of the cutting device 10, one can note that the two sidewalls 12 are formed from one continuous piece of plastic material. A portion 32 of one sidewall 12 overlaps the other sidewall 12. The pliable and resilient plastic sidewalls 12 form a casing 14 which one can force open to insert either a single edge razor blade of a certain thickness or a double edge razor blade of a thinner thickness than the single edge razor blade. Once a person has inserted the razor blade 18, the resilient casing 14 springs back to secure the razor blade 18 in place. The preferred embodiment of the present invention is formed from a plastic, such as polystyrene, although alternative embodiments have been formed from metals.

Referring now to FIG. 4, which is a cross-sectional side view of the cutting device 10, the razor blade 18 is shown inserted within the casing 14. In FIG. 5 a top plan view of the cutting device presents the shape of the two tabs 20 by which the person holds the casing 14 with his thumb and second finger.

Until the present invention there have been no plastic holders for holding and controlling a razor blade while cutting materials. The advantage of a plastic holder includes several features such as ease of changing razor blades and interchangeability of single edge and double edge razor blades. Furthermore, the holder is a one piece plastic device and may be manufactured in a single step process of injection molding which is not only economical in terms of time and labor costs, but also provides a cutting device which will have a relatively long useful life because nothing can mechanically go inoperative. An exacto knife, by contrast, secures its blade by having a sheath tightened about the blade. There is a possibility that the sheath, which is metallic, may rust, making the exacto knife mechanically inoperative. In addition, the sheath securing the blade of the exacto knife has a tendency to loosen under extreme cutting pressure thereby causing the blade to slip.

Thereby, from the foregoing it can be seen that a plastic holder for holding a razor blade has been described. The device is used to precisely control the cutting of various materials. Additionally, it should be noted that the device is not drawn to scale and that relationships of and between the figures of the drawing are not to be considered significant.

Accordingly, it is intended that the foregoing disclosure and showings made in the drawing shall be considered only as illustrations of the principles of the invention.

I claim:

1. A hand held cutting device which a person holds with his thumb and his second finger and guides with his first finger, comprising:

a. a rectangular razor blade of a certain size;

b. a first sidewall and a second sidewall, each of said sidewalls being substantially parallel to each other and substantially the same size as the size of said razor blade and having a top edge, a front edge, a back edge and a bottom edge, said bottom edges, said front edges and said top edges of said first and second sidewalls being joined together to form a casing in which to insert said razor blade with a corner portion of said sidewalls adjacent to said bottom edges and said front edges being removed in order to expose a portion of the cutting surface of said razor blade;

c. a first tab and a second tab coupled to said back edges of said first and second sidewalls, respectively, and adapted so that a person can hold said casing between his thumb and his second finger said tabs being bent downwardly and away from each other at an acute angle from said top edges; and d. an elliptical plate coupled to said top edges of said adjoining sidewalls directly over the forwardmost part of said razor blade and disposed perpendicularly thereto and adapted to accommodate the first finger of the person so that a person can guide said cutting device with his first finger.

2. A hand held cutting device according to claim 1 wherein said razor blade is a single edge safety blade.

3. A hand held cutting device according to claim 2 wherein said handle is formed from a metallic material.

4. A hand held cutting device according to claim 2 wherein said handle is formed from a plastic material.

5. A hand held cutting device according to claim 1 wherein said razor blade is a double edge safety blade.

* * * * *